United States Patent [19]

Powell

[11] Patent Number: 4,600,926

[45] Date of Patent: Jul. 15, 1986

[54] TELEVISION ANTENNA

[76] Inventor: Stanley L. Powell, 3885 Sunhaven La., Kingman, Ariz. 86401

[21] Appl. No.: 518,030

[22] Filed: Jul. 28, 1983

[51] Int. Cl.[4] ..... H01Q 11/12

[52] U.S. Cl. ..... 343/742

[58] Field of Search ..... 343/741-744, 343/748, 788, 842, 866-870, 728, 732, 803, 804

[56] References Cited

U.S. PATENT DOCUMENTS

| | | | |
|---|---|---|---|
| D. 185,962 | 8/1959 | Vitanza | D26/14 |
| 2,297,427 | 9/1942 | Neidhardt | 343/866 |
| 2,419,539 | 4/1947 | Clark et al. | 250/33 |
| 2,460,260 | 1/1949 | Kibler | 250/33 |
| 2,501,430 | 3/1950 | Alford | 343/741 |
| 2,615,134 | 10/1952 | Carter | 250/33 |
| 2,622,196 | 12/1952 | Alford | 343/742 |
| 2,818,562 | 12/1957 | Carter | 343/742 |
| 3,474,452 | 10/1969 | Bogner | 343/726 |
| 3,514,780 | 5/1970 | Petrick et al. | 343/830 |
| 3,626,418 | 12/1971 | Berryman, Jr. | 343/742 |

OTHER PUBLICATIONS

"The ARRL Antenna Book" Ch. 2, pp. 2-27-2-30, published by the American Radio Relay Leaugue, Newington, CT, 14th Ed., 1983.

*Primary Examiner*—Eli Lieberman
*Assistant Examiner*—Michael C. Wimer
*Attorney, Agent, or Firm*—Charles E. Cates; Victor Myer

[57] ABSTRACT

An omni-directional antenna having two circular conductors of about $16\frac{3}{4}$ inches in diameter, concentrically disposed in planes about 4 inches apart is disclosed. The adjacent ends of the two circles of wire are each connected together. The connected ends are insulated from each other and are connected to a lead in transmission line of 300 ohms impedance.

2 Claims, 2 Drawing Figures

TELEVISION ANTENNA

BACKGROUND OF THE INVENTION

The reception of home television continues to expand into areas distant from large cities and receivers are frequently located in areas of mountains and valleys wherein TV reception is difficult. The fact that television reception involves both a video (picture) signal and an audio (voice) signal accentuates the antenna problem because the same antenna has to receive both signals. The advent of the UHF bands has extended the frequency range from about 54 megacycles to about 800 megacycles. With each increase in frequency, the problems of an adequate antenna become greater.

It goes without saying that a single antenna should be usable to receive all of the channels. To require switching from one antenna to another is undesirable, even though at the present time separate antennas are usually provided for the VHF and the UHF regions, and one must switch from one antenna to the next for this purpose. Further, a TV antenna should be omni directional in that the signal should be receivable from any direction on the horizon without the necessity for rotating the antenna from one direction to the other. Similarly the same antenna should be usable for color reception as well as for black and white reception. Antennas for these purposes are, at least generally, available. But the overall reception they provide in low signal areas is far from satisfactory.

Currently, in the vicinity of strong signal sources such as locations near the broadcasting antenna as in the case of large cities no particular problems, perhaps, exist with respect to receiving the various channels satisfactorily. However, in remote locations as in mountainous areas including valleys, reception is frequently poor and sometimes non-existent and also in remote areas where it is simply a matter of a distance from the transmitter is too great, the reception is poor.

Antennas known to the art include those shown in the U.S. Pat. Nos. 2,615,134, Oct. 21, 1952 to P. S. Carter and the U.S. Pat. No. 3,626,418, Dec. 7, 1971 to Berryman, Jr. Antennas according to these patents (FIG. 3 of the Carter patent) have been constructed and tested. They give adequate reception only in a very limited number of instances.

SUMMARY OF THE INVENTION

It is an object of the invention to provide an improved TV receiving antenna that will give good reception with both the VHF and the UHF ranges of frequencies.

It is a further object of the invention to provide an improved TV antenna of the character indicated for use in low signal areas.

It is a further object of the invention to provide an improved TV receiving antenna of the character indicated that is simple in form, easy to construct, and efficient in operation.

In carrying out the invention according to one form, there is provided an antenna comprising a single pair of conductors each arranged in a circle whose circumferences are equal to each other and whose diameters are equal to about 16¾ inches; the circular conductors are concentrically arranged, disposed in planes parallel to each other and spaced about 4 inches apart; and the respective ends of the two conductors are connected together but the ends of each conductor are insulated from each other; the connected ends being adapted to being connected to input antenna terminals of a utilization device such as a television set. The conductors have a size of about #10 A.W.G. wire. It has been found that the dimensions given may be varied somewhat and the values given aren't necessarily absolutely critical, but it has been found that the values given are optimum for most areas.

The antenna is simple and has no moving parts. It will receive all of the VHF channels, all of the UHF channels and the complete FM band from 88 MHz to 108 MHz without modification. The antenna is designed for 300 ohms of impedance and will work on any TV set or FM radio with regular 300 ohm twin lead in wire. In this instance no matching transformers are required. The antenna works equally well on color sets and black and white sets and the signals may be picked up in a 360° direction both in a vertical and horizontal planes without loss of strength. Likewise, the antenna will work on moving vehicles, boats or fixed installations.

It has been found that with a strong signal from the transmitter, the antenna will give a good picture up to a distance of about 60 miles. In extreme installations, such as on a lake surrounded by mountains in an isolated area, or near, or under, a steel bridge, the antenna will work effectively, minimizing ghosts and shadows, and giving a clear picture. For extreme distances, two of the antennas may be stacked in a vertical direction, one above the other, for increased single strength. While the antenna is designed for outdoor installation it may be used indoors in apartments and garages, for example. The antenna is compact and will not be effected by wind, rain, snow or ice in the performance of its function.

The antenna is omni-directional, inexpensive to manufacture, and light in weight. It can be weather-proofed and is so simple to install that any user can mount it himself.

BRIEF DESCRIPTION OF THE DRAWINGS

For a more complete understanding of the invention, reference should be had to the accompanying drawing in which.

DESCRIPTION OF THE PREFERRED EMBODIMENT

Figure 1:
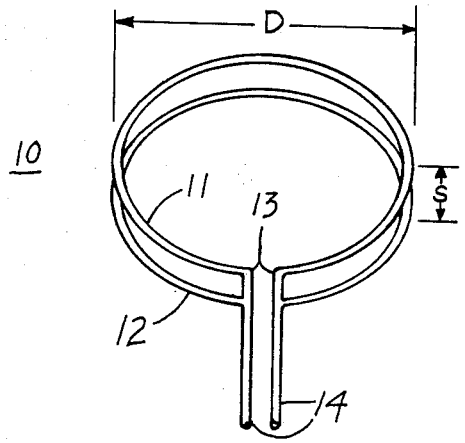
FIG. 1 is a diagrammatic view in prospective of an antenna embodying the invention.

Referring to the drawings, the invention is shown diagrammatically in FIG. 1 as antenna 10, consisting of two circles of wire 11 and 12. The two ends of the circle of wire 11 are connected to the two ends of the circle of wire 12 by some convenient conducting pieces 13. The pieces 13 which is to say the ends of the circular conductors 11 and 12 are insulated from each other by any convenient spacing such as air, for example. Solid insulation may be used and the gap may be about ¼ of an inch. The connected ends of the circular conductors 11 and 12 as by the pieces 13 are connected to a 300 ohm transmission line 14 through which the signals picked up by the antenna is conducted to the input terminals of a utilization device, for example, a TV set. For good results and according to at least one form of the invention, the circles 11 and 12 of the conductors have a diameter D which may be about 16¾ inches. The planes of the circles 11 and 12 are parallel to each other and are spaced apart a distance S which according to one form of the invention may be about 4 inches.

A good wire size for the two circles 11 and 12 was found to be No. 10 A.W.G.

Figure 2:
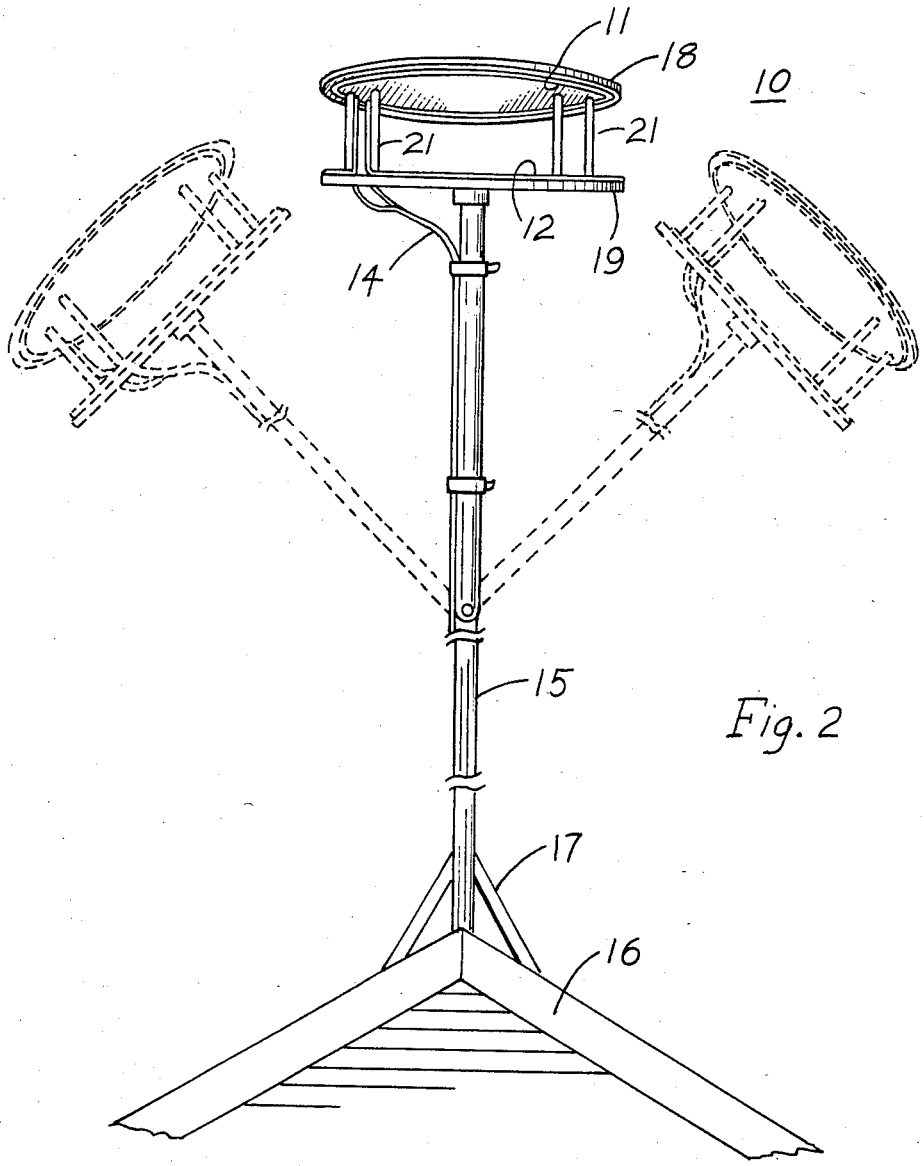
FIG. 2 is an elevational view partially in prospective of an embodiment of the invention.

Referring to FIG. 2 the antenna 10 is shown embodied in a practical form supported on a vertical pole 15 which is attached to the peak of a roof 16 in any well-known manner. Braces 17 may be used to insure that the pole 15 remains fixed or rigid. At the top of the pole 15 the antenna 10 is supported in any well-known manner, the antenna in this instance including the two wire circles 11 and 12 attached to circular pieces of plywood for example 18 and 19, respectively. The pieces of plywood 18 and 19 are merely insulating boards for supporting the conductors 11 and 12 so that the conductors will remain in their respective planes and parallel to each other.

Other insulating materials may be used in place of plywood, for example, one of the synthetic or plastic materials such as nylon or polyethylene, for example. The circles of wire may be attached to the boards by insulating clamps, staples, or the like. The wire could be molded directly into or on the plastic sheets.

The proper spacing between conductors 11 and 12 and the plywood pieces 18 and 19 is maintained in the actual example by means of small dowel pieces 21. Thus the plywood pieces 18 and 19 and the dowels 21 form a relatively rigid framework for supporting the conductors 11 and 12.

It has been found that the antenna may be tilted to one side or the other of the vertical as shown by the dotted lines in FIG. 2. The tilting may be as much as 30° in each direction.

With the antenna constructed as described, the input impedance thereof was approximately 300 ohms, the variation being about plus or minus 20 ohms. Because of this value the lead-in transmission line 14 can be the conventional 300 ohm transmission line. If variations in input resistance of the connected conductors 11 and 12 are too great or too small relative to the 300 ohmic value, matching transformers would have to be used.

The diameter D of $16\frac{3}{4}$ inches, the spacing S of about 4 inches and the size of the conductors of #10 A.W.G. are values that have been found to be optimum and in some senses, relatively critical, particularly the 4 inch spacing S. However, it has been found that some variations are permissible in these perimeters. It has been found that the wire size of conductors 11 and 12 should not be any greater than #18 A.W.G. and while it may be larger than #10 A.W.G. down to a size of about #6 A.W.G. has been found satisfactory.

The idea of the omni-directional antenna is achieved by having the conductors 11 and 12 circular thereby receiving the radiant energy equally from all directions.

Changing the diameter from $16\frac{3}{4}$ inches to $8\frac{3}{8}$ inches, that is to say making it equal to one-half and leaving the other constants the same, the distance ability of the antenna to receive a signal was reduced to about 40 to 50%, the quality of the picture remaining about the same. If at the same time the distance S was reduced to 2 inches while the diameter was also reduced to $8\frac{3}{8}$ inches the picture quality deteriorated substantially and the audio was garbled on virtually all channels. Changing the wire size from #6 A.W.G. to #18 A.W.G. in this instance did not improve the results. When the diameter D was increased to 22 inches and the distance S was changed to 3 inches, poor picture quality resulted and the audio signal was not distinct.

It is clear that a simple and efficient antenna has been achieved.

I claim:

1. A TV antenna for the VHF and UHF bands, audio and video, and the FM band from a frequency of about 60 megacycles to about 884 megacycles comprising a single pair of conductors with respective ends, each arranged in a circle whose circumferences are equal to each other and whose diameters are equal to about sixteen and three-quarter inches, said circular conductors are concentrically arranged, disposed in planes parallel to each other and spaced about four inches apart, and the respective ends of said pair of conductors are connected together, the ends of each single conductor being disposed immediately next to but insulated from each other, the said connected ends being adapted to be connected to input antenna terminals of a utilization device, and said conductors having a size between #6 A.W.G. and #18 A.W.G. wire.

2. The antenna according to claim 1 wherein said conductors have a size of about #10 A.W.G. wire.

* * * * *